United States Patent [19]

Miller

[11] 4,227,361

[45] Oct. 14, 1980

[54] METHOD OF CONSTRUCTING A SWIMMING POOL

[75] Inventor: Clarence J. Miller, Canton, Ohio

[73] Assignee: Bradley Enterprises, Inc., Canton, Ohio

[21] Appl. No.: 20,950

[22] Filed: Mar. 16, 1979

[51] Int. Cl.[2] ..... E04H 3/16

[52] U.S. Cl. ..... 52/742; 52/169.7

[58] Field of Search ..... 52/169.7, 742; 4/172.21, 172.19, 172 R

[56] References Cited

U.S. PATENT DOCUMENTS

| | | | |
|---|---|---|---|
| 2,978,840 | 4/1961 | Tatsch | 52/169.14 |
| 3,429,085 | 2/1969 | Stillman | 52/169.7 |
| 3,468,088 | 9/1969 | Miller | 52/169.7 |
| 3,487,599 | 1/1970 | Jansen | 52/169.7 |
| 3,638,378 | 2/1972 | Russ | 52/169.7 |
| 3,771,175 | 11/1973 | Goetti | 4/172.19 |
| 4,027,442 | 6/1977 | Silverman . | |

*Primary Examiner*—John E. Murtagh

*Attorney, Agent, or Firm*—Frease & Bishop

[57] ABSTRACT

A method of constructing a swimming pool which includes the steps of forming an excavation of desired size and shape in the ground, the excavation including a footing area, placing polyethylene film over the footing area and a portion of the remaining excavation surface, setting a wall member on the footing area, pouring a concrete footing on the footing area to embed a portion of the wall, applying a groove-forming device to the wall, pouring additional concrete to form the pool bottom, removing the groove-forming device to expose a groove, and filling the groove with caulking material. An alternative method of forming the pool bottom includes the steps of spraying layers of polyurethane foam on the excavation to form the pool bottom.

7 Claims, 9 Drawing Figures

METHOD OF CONSTRUCTING A SWIMMING POOL

BACKGROUND OF THE INVENTION

1. Field of the Invention

This invention relates to a method of building or constructing swimming pools. More particularly the invention relates to a method of building swimming pools and like structures which greatly increases the flexibility of construction scheduling and permits, if desired, an extended program of construction as, for example, several weeks or even months that may be necessitated by inclement weather or other construction scheduling factors.

2. Description of the Prior Art

In-ground swimming pools have been built using many methods of construction, and many types are currently available in the commercial market. Such types include pools manufactured from concrete, tile, or concrete block. These types of pools are relatively expensive to build because of the cost of the labor involved and because of the cost of the materials from which the pools are constructed, high cost of transportation and handling.

Another type of commercially available pool is the so-called vinyl-liner pool of which there are many styles. While being somewhat less expensive than the aforementioned construction, the vinyl-liner pool is much less durable and subject to leaks through puncture of the liner, thus presenting maintenance problems, particularly for a residential pool owner.

An entirely satisfactory pool construction is shown and described in my U.S. Pat. No. 3,468,088 which incorporates a continuous sheet of resin-impregnated fiber glass wall reinforced with concrete pockets and a concrete bottom. However, events of recent years have created several problems when this construction is employed.

First, it has become difficult to obtain the services of skilled craftsmen who are willing and qualified to work with concrete. As a consequence, it may not be possible to schedule the concrete worker at the most opportune time with respect to the scheduling of other workers who are building the swimming pool. Delays could thus result which could lead to customer dissatisfaction and an improperly built swimming pool.

Further, weather is an important factor in the construction of a swimming pool in which concrete is employed. If, for example, the skilled craftsmen are scheduled to perform their work on a particular day to fit the schedule of other workers, and inclement weather should arise, it may become necessary to either reschedule the concrete work or risk the possibility of rain or other weather damaging or affecting the quality of the finished pool, requiring removing and rebuilding portions partially complete.

Additionally, the availability of concrete, which has become in short supply, particularly in certain areas of the country, is a further factor. Thus, it may not be possible to obtain concrete in the quantity necessary on the particular day in which it is desired. In the normal situation it is undersirable to form portions of a swimming pool bottom from concrete and return at a later time to apply additional concrete because so-called "cold joints" will exist between the earlier and later poured concrete and these cold joints could lead to leakage of water from the pool.

Accordingly, it is a primary object of the present invention to provide a method of constructing a swimming pool in which the various phases of construction can be accomplished at the most convenient time with respect to all factors that might affect construction, such as availability of workers, availability of materials, and good weather. Other objects of the present invention include the method of constructing a swimming pool in which it is not necessary to pour the concrete which reinforces the fiber glass wall at the same time that the pool bottom is poured, in which the construction of the pool may be accomplished over an extended period of time to accommodate for example, the financial resources of the pool buyer in which fewer and less skilled workers are required to build the pool and in which an alternate method of construction of the pool bottom from polyurethane foam can be employed if desired.

These and other objects are obtained by the methods, steps, procedures, parts, constructions, arrangements, combinations and subcombinations comprising the present invention, a preferred embodiment of which, illustrative of the best mode in which applicant has contemplated applying the principles are set forth and illustrated in the accompanying drawings and are particularly and distinctly pointed out in the appended claims.

SUMMARY OF THE INVENTION

The present invention can be stated in general terms as a method for constructing a swimming pool which includes the steps of first forming an excavation in the ground to the desired size and shape which excavation includes a horizontal footing area, a side area and a bottom area, with the footing area extending between the bottom and the side.

Next, a film of waterproof material, such as polyethylene, is placed over the footing area and at least a portion of the bottom. A vertical wall member is then supported upon the footing area by an suitable means and a concrete footing is then formed on the horizontal footing area with the bottom portion of the vertical wall member being embedded in the concrete footing. A groove-forming device is then attached to the vertical wall member a desired distance above the concrete footing. Additional concrete is then poured to form the remainder of the bottom. The additional poured concrete is placed to a position where the groove-forming device is embedded in the additional concrete. After the additional concrete has set, the grooveforming device is removed to expose a groove formed in the additional poured concrete. The groove is then filled with a waterproof caulking material to seal the seam formed between the additional concrete and the vertical wall member. The pool bottom may then be painted or finished with any other desired material.

Alternatively, the bottom may be constructed by spraying a plurality of layers of polyurethane foam to form the pool bottom after the concrete footing has set.

It is not necessary that the additional concrete that forms the bottom be poured at the same time that the footing is formed. This additional concrete can be poured days, or even weeks, after the footing has been poured because the waterproof film will protect the exposed surfaces of the excavation from the effects of inclement weather.

BRIEF DESCRIPTION OF THE DRAWINGS

By way of example, the improved methods of the present invention are illustrated in the accompanying drawings forming a part hereof wherein similar numerals indicate similar parts throughout the various figures and in which.

DESCRIPTION OF THE PREFERRED EMBODIMENT

Figures 1, 8, 9:
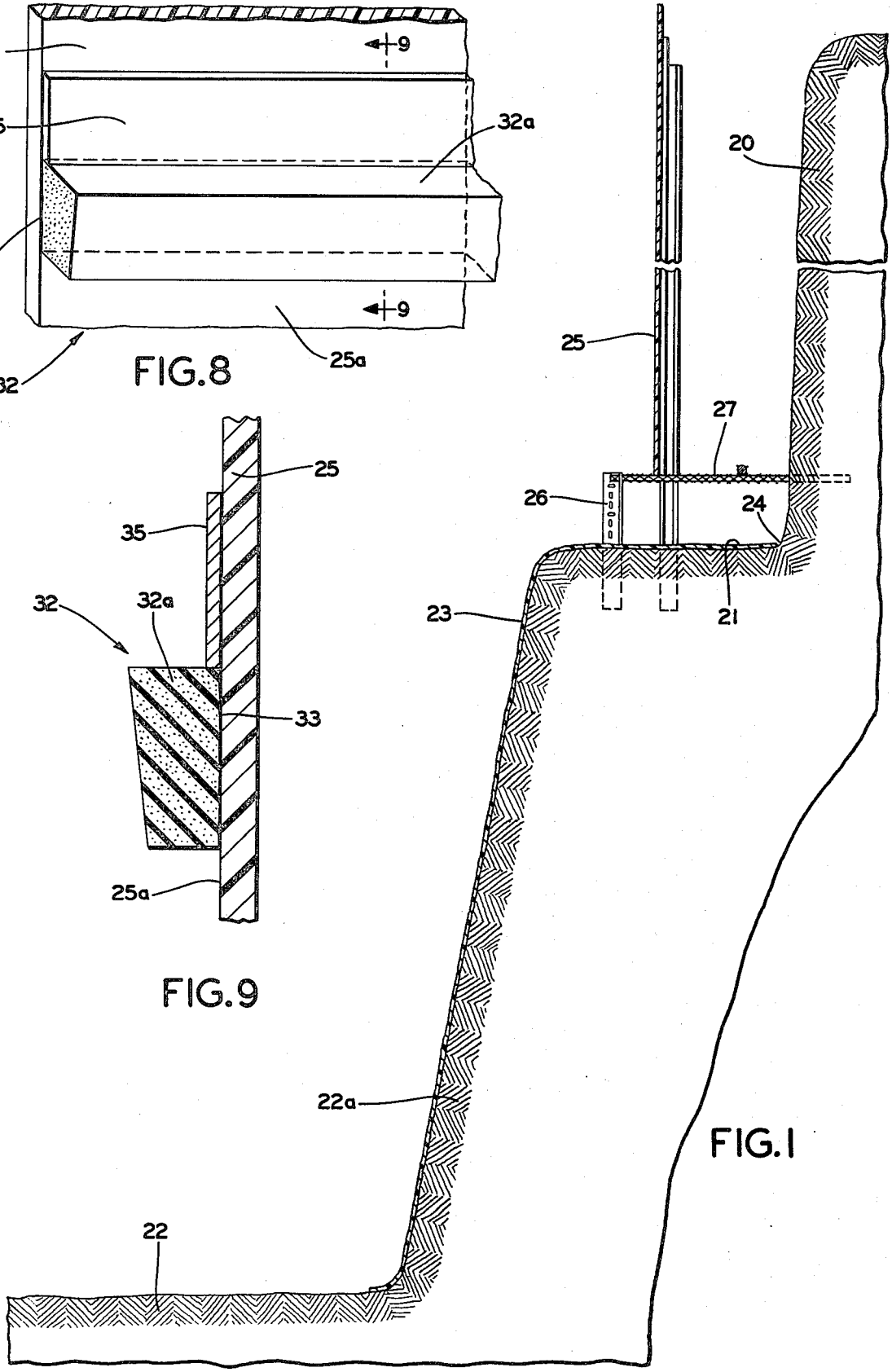
FIG. 1 is a fragmentary cross-section of the swimming pool being constructed in accordance with the principles of the present invention and in which the initial steps are illustrated.
FIG. 8 is an enlarged fragmentary perspective view showing a portion of the groove-forming device attached to the wall member.
FIG. 9 is a fragmentary section taken on the lines 9—9, FIG. 8.
Figure 4:
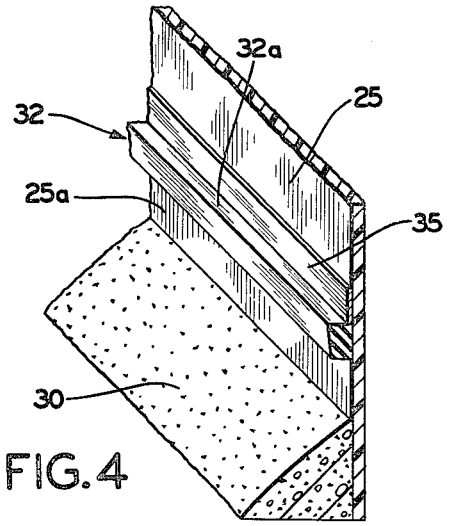
FIGS. 4 through 7 are fragmentary cross-sections illustrating the steps of applying the groove-forming device, pouring additional concrete, removing the groove-forming device and filling the groove with caulking material.
Figure 2:
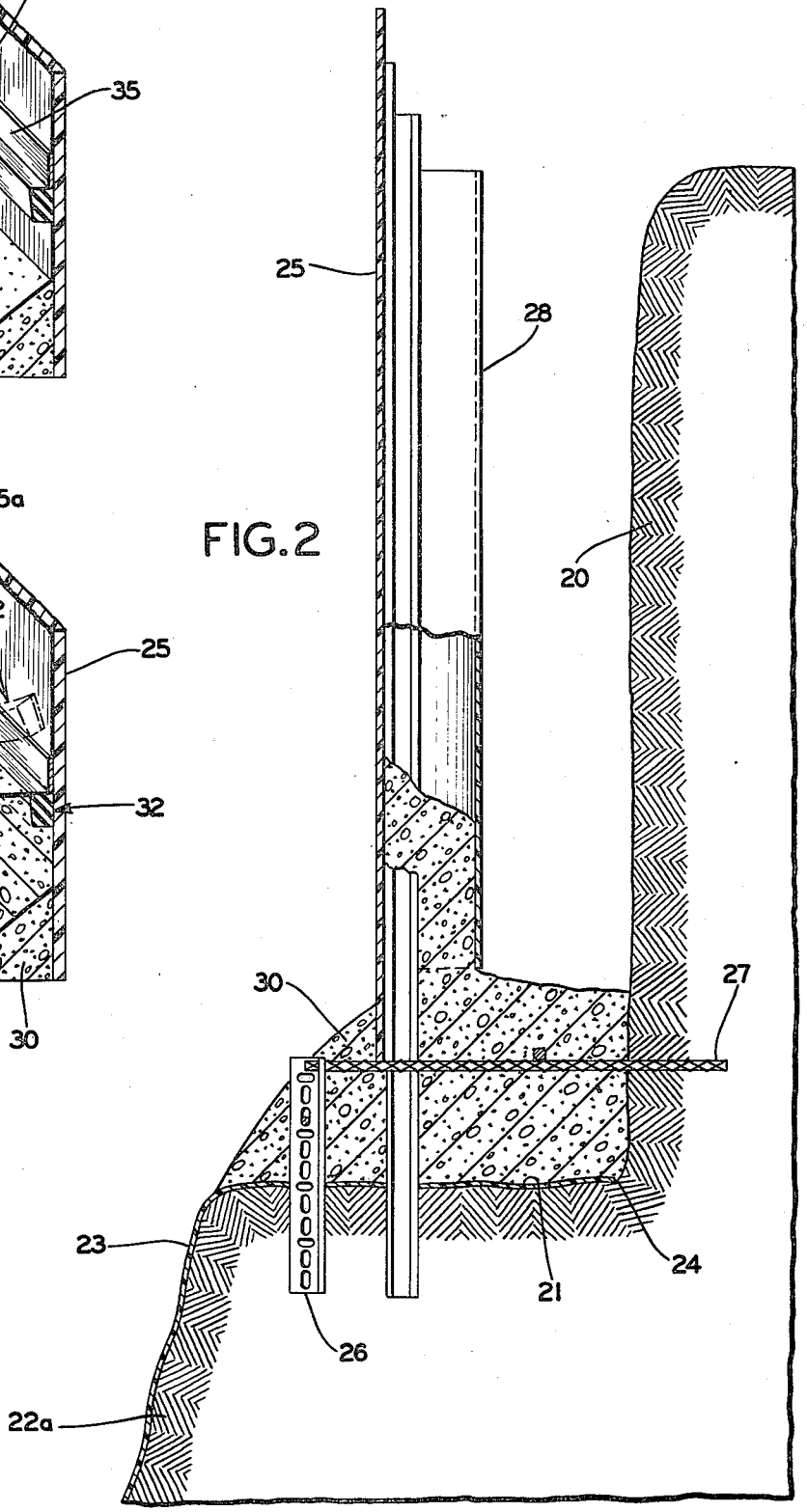
FIG. 2 is a fragmentary cross-section showing the excavation and side wall after the footing has been poured.
Figure 6:
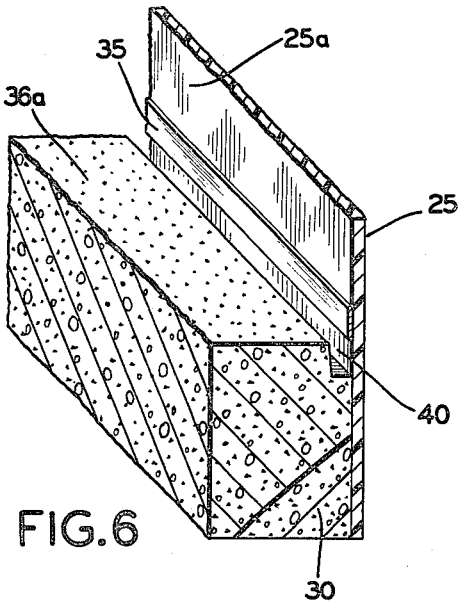
Figure 7:
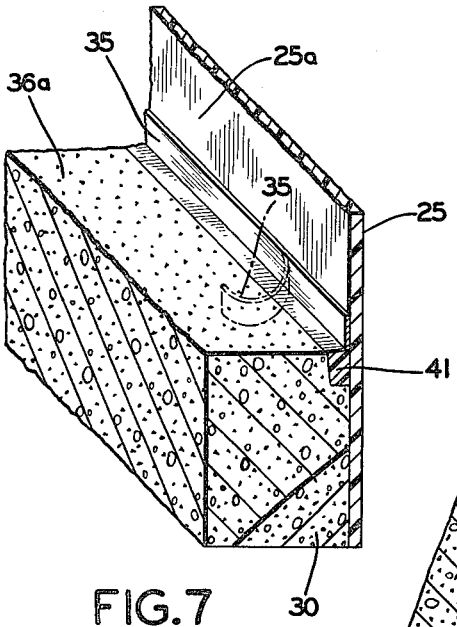
Figure 3:
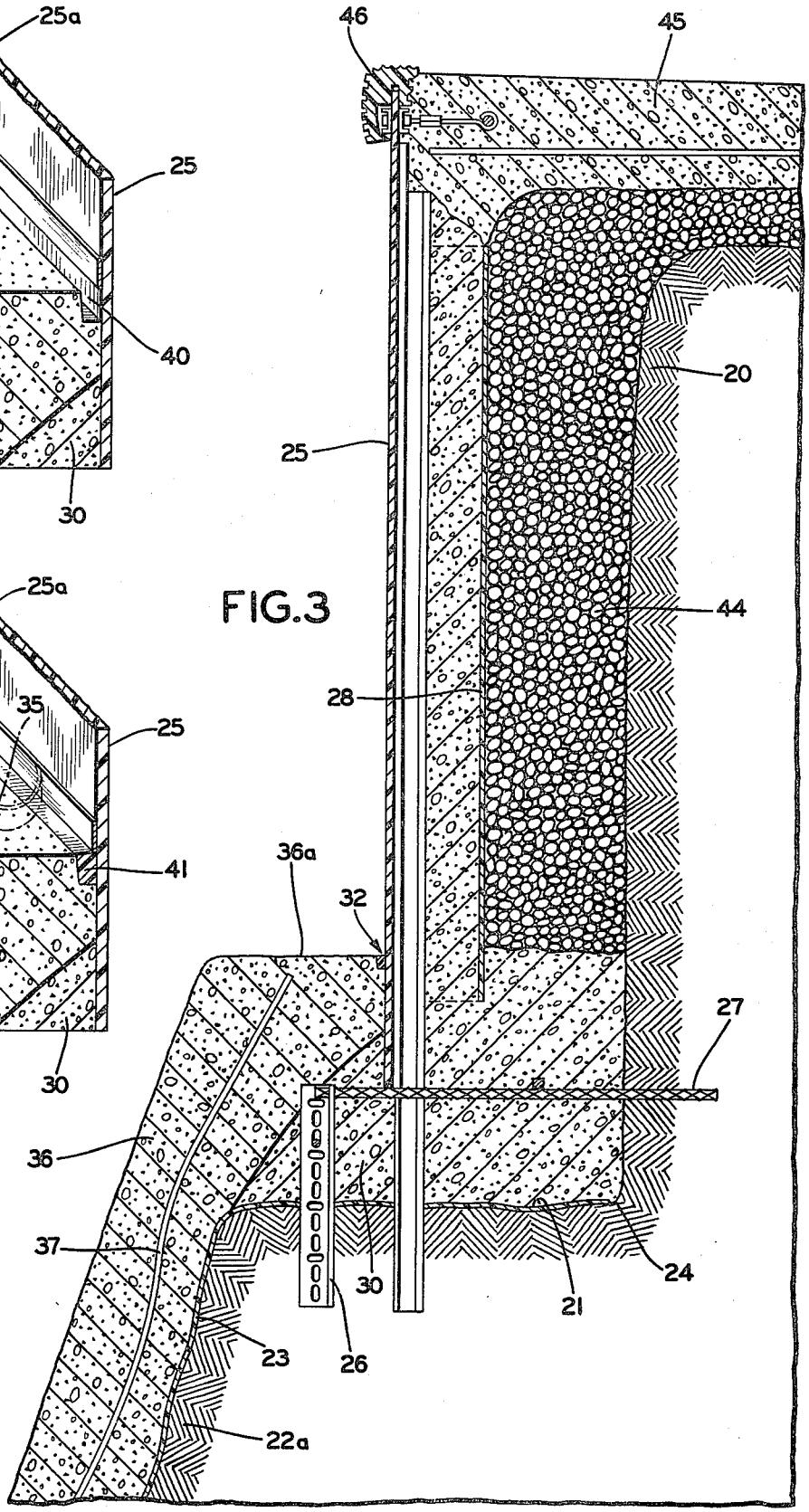
FIG. 3 is a fragmentary cross-section showing the swimming pool side wall and bottom after completion.

Referring now specifically to the drawings of the present invention, FIGS. 1 through 3 illustrate the method of the present invention during various phases of the various method steps. FIGS. 4 through 9 illustrate certain of the steps of the present invention which are important to the accomplishment of the objectives of the invention.

In FIG. 1 an in-ground excavation is illustrated for a swimming pool and includes a side wall area 20, a footing area 21 and the bottom 22 which also includes a sloping bottom portion 22*a*. Side wall area 20 is substantially vertical, footing area 21 is substantially horizontal and bottom 22 is substantially horizontal, while the slope of bottom area 22*a* can be that which is desired while taking into consideration safety factors for the finished pool. Further, most swimming pools have a shallow end and a deep end and at the shallow end of the pool it may be unnecessary for there to be a sloping side wall portion 22*a* since the height of the wall in this area will be approximately as deep as the water is to be in the shallow end.

In accordance with the procedures of the present invention, after the excavation has been formed in the ground, a film or sheet of waterproof material 23 is placed upon the ground in the footing area 21 and bottom portion 22*a*. This film or sheet 23 can be of any suitable material and any suitable size, however, polyethylene sheeting of approximately 2 to 5 mills in thickness can be satisfactorily employed. These sheets can be of any convenient size and, for example, be cut from a roll of film in lengths necessary to extend from the point 24 where the footing area 21 and side wall 20 converge to the bottom area 22 of the excavation. A plurality of these sheets can be placed in slightly overlapping fashion so that the entire area to be covered has sheeting placed thereon.

After placing the film over those areas to be covered, the swimming pool side wall member 25 is set into place. The side wall member 25 is preferably a continuous sheet of resin-impregnated fiber galss and is supported on edge by vertical support 26 and horizontal support 27 which has one end supported by vertical support 26 and the other end supported in the ground. The structure of the fiber glass side wall and reinforcing pockets of concrete are illustrated and described in my U.S. Pat. No. 3,468,088. These pockets are illustrated in FIG. 2 and FIG. 3 and are indicated by reference numeral 28.

In accordance with the present invention after the side wall has been set, a footing 30 of concrete is poured onto footing area 21 on top of the waterproof sheeting 23 in such an amount as to embed a portion of the lower edge of side wall 25 as well as substantially all of support 26 and horizontal support 27. Footing 30 is allowed to set and at this stage of construction the additional steps of the method of the invention may be continued immediately or they can be delayed and scheduled for some time later, either days or weeks depending upon the convenience and scheduling problems of the pool builder. With the pool at this stage of construction, as shown in FIG. 2, the semi-finished pool can remain exposed to the elements since the film 23 of waterproof material will protect the sloping portion of the bottom from weather erosion and other water penetration. Further, the side of the excavation 20 need not normally be protected from the weather since the space between excavation site 20 and the inner surface of the side wall member 25 will ultimately be filled with a suitable backfill material, such as gravel.

In proceeding to the next stages of construction, two alternative courses can be followed. In the preferred embodiment the remaining portion of the bottom is constructed of concrete. However, the pool bottom can be constructed from sprayed polyurethane foam in the manner disclosed in my copending application Ser. No. 20,625 filed Mar. 15, 1979.

In the preferred embodiment disclosed in the present application the pool bottom is constructed of concrete and this additional concrete will be poured at some time after the concrete which forms footing 30 has set.

In accordance with the principles of the present invention, a groove-forming device 32 is attached to the interior surface 25*a*of pool side wall member 25, the interior surface being that surface which will form the side of the swimming pool which contains the water. The groove-forming device 32 is placed around the entire perimeter of the pool a short distance above the top of footing 30 and is fixed in a manner so that the top 32*a* of the device is substantially level throughout its entire length.

Groove-forming device 32 can be constructed of any suitable material, however, one such material which has been found to be entirely satisfactory consists of an elongated length of sponge rubber having a trapezoidal cross-section and having a pressure-sensitive adhesive 33 applied to one surface. Device 32 is attached to a wall in a position such that one of the longer of the two legs of the trapezoid forms the top 32*a* so that the device which will be removed at a later time can be removed with relative ease. After the groove-forming device 32 is attached to the side wall, masking tape 35 is attached to the surface of side wall 25 directly above groove-forming device 32.

Figure 5:
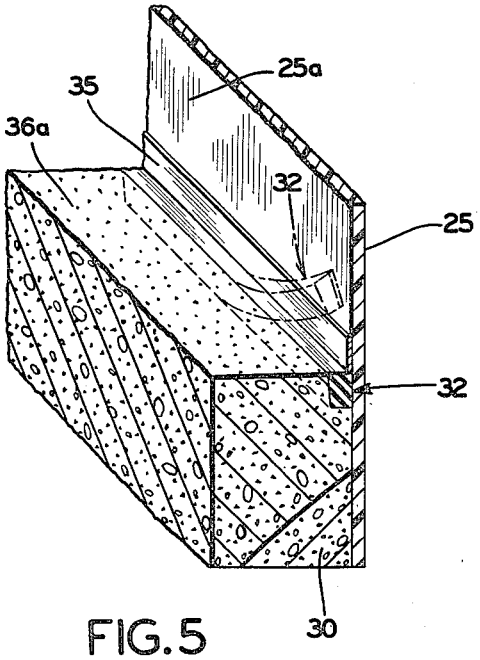

For the purposes of the present invention, it is immaterial whether groove-forming device 32 or masking tape 35 is placed on the wall first. However, they are placed on the wall adjacent to one another and extend entirely around the perimeter of the pool above the footing. After affixing the groove-forming device 32 and masking tape 35 to the side wall member 25, additional concrete is poured throughout the entire bottom of the swimming pool 22 and 22*a* to form the swimming pool bottom. This additional concrete 36 is placed over footer 30 and extends upwardly along the lower edge of side wall 25 and encloses groove-forming device 32 as best seen in FIG. 5. The top surface 36*a* which ultimately will define a safety walk area for the swimming pool is flush with the top surface 32*a* of groove-forming device 32. The additional poured concrete may be reinforced with wire mesh 37 as shown in FIG. 3.

After the additional poured concrete 36 has set, the groove-forming device 32 is removed to form a groove 40 which is defined by the space that had been occupied by groove-forming device 32. This groove is then filled with a waterproof caulking material 41 to provide a waterproof seal between the concrete 36 and the side wall 25 to prevent any leakage of water from the pool in this area.

The exposed concrete surfaces of the pool may then be painted and after allowing the paint to dry, the masking tape 35 is removed from the wall and the pool may then be completed by placing a suitable backfill 44 between the excavation and the wall. A concrete deck 45 may be poured around the perimeter of the pool after having attached a suitable coping 46 to the top edge of the pool.

In the alternative method of constructing the pool bottom in which sprayed polyurethane foam is used to form the pool bottom, the caulking device 32 and masking tape 35 are not used. The procedures employed for spraying the polyurethane foam are disclosed in my copending application referred to above.

Important aspects of the present invention involve the methods employed wherein the concrete footing 30 can be poured at any convenient time without necessitating pouring of the entire bottom at the same time. This is made possible by the use of the polyethylene film to protect those areas of the excavation which would otherwise be subject to erosion or other damage from inclement weather.

Any potential leakage problems are avoided by using the groove-forming device 32 which provides a means by which the caulking can be placed in the groove to seal the area between the additional poured concrete and the side wall member of the pool. Thus, the cold joint between the additional poured concrete and the footing is unimportant to the quality or integrity of the swimming pool since this cold joint will be effectively sealed against water leakage.

Finally, it should be understood that the methods of the present invention can be used to construct any in-ground liquid container such as a water reservoir and is not limited to constructing swimming pools.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the new and useful methods are set forth in the appended claims.

I claim:

1. In a method of constructing a swimming pool of the type in which an excavation is formed in the ground, in which the excavation has a bottom and a horizontal footing area which supports a vertical wall member that forms at least a portion of a wall of the swimming pool, and in which the wall member has a bottom portion; the improvement which includes the steps of:

(a) forming a concrete footing on the horizontal footing area with the bottom portion of the vertical wall member embedded in the concrete footing;

(b) attaching removable groove-forming means generally horizontally to the vertical wall member at a desired distance above the concrete footing;

(c) pouring additional concrete over at least a portion of the concrete footing and upwardly against a portion of the vertical wall member to a position in which a portion of the groove-forming means is embedded in the additional concrete;

(d) removing the groove-forming means from the vertical wall member to expose a groove formed in the additional poured concrete; and (e) filling the groove with waterproof caulking material to seal a seam formed between the additional concrete and the vertical wall member.

2. The method of constructing a swimming pool as set forth in claim 1, which includes the step of placing waterproof sheeting over at least a portion of the footing area and a portion of the bottom of the excavation prior to the step of forming a concrete footing.

3. In a method of constructing a swimming pool, the steps of:

(a) forming an excavation in the ground, the excavation including a side, a horizontal footing area, and a bottom, with the footing area extending between the bottom and the side;

(b) placing waterproof sheeting over at least a portion of the footing area and a portion of the bottom;

(c) supporting a vertical wall member having a bottom portion upon the footing area;

(d) forming a concrete footing on the horizontal footing area with the bottom portion of the vertical wall member embedded in the concrete footing; and (e) applying a bottom finish material over at least a portion of the footing and upwardly against a portion of the vertical wall member, and over at least a portion of the excavation bottom.

4. The method of constructing a swimming pool as set forth in claim 3 in which the bottom finish material is concrete.

5. The method of constructing a swimming pool as set forth in claim 3 in which the bottom finish material is sprayed polyurethane foam.

6. The method of constructing a swimming pool as set forth in claim 3 which includes the steps of attaching removable groove-forming means to the vertical wall member at a desired distance above the concrete footing after the concrete footing has been formed, and removing the groove-forming means from the vertical wall member to expose a groove formed in the additional poured concrete after the bottom finish material has been applied; and filling the groove with waterproof caulking material to seal a seam formed between additional concrete and the vertical wall member.

7. A method of constructing a swimming pool or the like including the steps of:

(a) forming an excavation in the ground, the excavation including a side, a horizontal footing area, and a bottom, with the footing area extending between the bottom and the side;

(b) placing waterproof sheeting over at least a portion of the footing area and a portion of the bottom;

(c) supporting a vertical wall member having a bottom portion upon the footing area;

(d) forming a concrete footing on the horizontal footing area with the bottom portion of the vertical wall member embedded in the concrete footing;

(e) attaching removable groove-forming means generally horizontally to the vertical wall member at a desired distance above the concrete footing;

(f) pouring additional concrete over at least a portion of the concrete footing and upwardly against a portion of the vertical wall member to a position in which at least a portion of the groove-forming means is embedded in the additional concrete;

(g) removing the groove-forming means from the vertical wall member to expose a groove formed in the additional poured concrete; and (h) filling the groove with waterproof caulking material to seal a seam formed between the additional concrete and the vertical wall member.

* * * * *

UNITED STATES PATENT AND TRADEMARK OFFICE

CERTIFICATE OF CORRECTION

PATENT NO. : 4,227,361

DATED : October 14, 1980

INVENTOR(S) : Clarence J. Miller

It is certified that error appears in the above-identified patent and that said Letters Patent are hereby corrected as shown below:

Column 2, Line 42 - "an" should be - <u>any</u> -

Column 2, Line 52 - "grooveforming" should be - <u>groove-forming</u>

Column 4, Line 44 - A space should exist between "25a" and the word "of".

Signed and Sealed this

*Sixth* Day of *January 1981*

[SEAL]

*Attest:*

SIDNEY A. DIAMOND

*Attesting Officer*

*Commissioner of Patents and Trademarks*